US006040355A

United States Patent [19]

Kurple

[11] Patent Number: 6,040,355

[45] Date of Patent: Mar. 21, 2000

[54] FOUNDRY CURING SYSTEM

[76] Inventor: Kenneth R Kurple, 9533 Springborn Rd., Anchorville, Mich. 48004

[21] Appl. No.: 09/108,623

[22] Filed: Jul. 1, 1998

[51] Int. Cl.[7] ..... B22C 1/20

[52] U.S. Cl. ..... 523/139; 523/142; 523/143; 524/590

[58] Field of Search ..... 523/142, 139, 523/143

[56] References Cited

U.S. PATENT DOCUMENTS

| | | | |
|---|---|---|---|
| 4,426,484 | 1/1984 | Saeki et al. | 523/145 |
| 4,814,012 | 3/1989 | Paul et al. | 106/38.51 |
| 4,851,457 | 7/1989 | Kurple | 523/142 |
| 5,382,608 | 1/1995 | Gardzielia et al. | 524/594 |
| 5,786,409 | 7/1998 | Kurple | 523/142 |

*Primary Examiner*—David W. Wu
*Assistant Examiner*—Ling-Siu Choi
*Attorney, Agent, or Firm*—Woodling, Krost and Rust

[57] ABSTRACT

A process of making sand cores and molds without the necessity of using an amine gas or sulphur dioxide gas to act as a catalyst by coating sand with a foundry resin which is capable of holding the sand in the proper shape after molding of the core or mold which foundry resin may be of a conventional construction. After the core or mold has been formed, hot air having a temperature of at least 180° F. and in the range of from there to 1000° F. is passed through the formed core to harden the core or mold at a rate sufficiently high to satisfy high production conditions without the necessity of toxic amines or sulphur dioxide.

4 Claims, No Drawings

FOUNDRY CURING SYSTEM

Presently in order to produce sand cores by a fast production method, certain foundry resins are mixed with sand and formed into a specific shape. Then an amine gas such as triethylamine or sulfur dioxide which has been mixed with an inert gas is passed through the sand core. The presence of an amine gas acts as a catalyst such that it increases the speed of the curing reaction of the resins on the sand. This allows the sand core to harden so that it has sufficient strength that molten metal such as iron, aluminum and other metals can be poured around the sand core to produce a hollow cavity for casting. The present system uses triethylamine gas which is a very toxic gas. It must be removed from the sand core by means of a purge cycle of air so that the residual amine gas is removed from the sand core. A tremendous number of sand cores are used in a foundry and these sand cores emit this residual amine gas which is now under severe environmental and occupational regulations. Workers are exposed to this gas which is very toxic. Also amine gases require a scrubber to remove these gases from exhaust air.

This invention does not require an amine gas or sulfur dioxide gas to act as a catalyst in the chemical reaction of the foundry resin on the sand in the core part. What has been invented is that hot air which has been heated by various means to a temperature of at least 180° F. and preferably to 1000° F. is passed through the formed core. This hot air acts as a catalyst to increase the rate of reaction or curing in order to make it possible for the sand cores to harden at a rate sufficiently high to satisfy high production conditions. Generally speaking every 20° F. increase in that temperature means the rate of a chemical reaction will double. This makes it possible to obtain high production rates of foundry sand cores by increasing the temperature of the hot air that is passed through the cores. This new invention eliminates the need for toxic amines or sulfur dioxide and also the need for scrubbers to remove these toxic gases from the air stream. This new invention makes it possible to significantly improve production rates of foundry sand cores because a purge cycle is no longer needed to remove the residual amines that are trapped on the inside of the cores.

EXAMPLE 1

In a suitable mixer 5,000 grams of sand are mixed with 50 grams of a suitable foundry resin. And then after this is allowed to mix for one minute, then another 50 grams of a suitable curing agent such as an isocyanate containing material is added to resin sand mixture. After this mixture is allowed to mix for one minute, this resin coated sand is placed in a piece of equipment where hot air of a temperature of 270° F. is passed through this sand core for one minute which causes the sand core to harden so that it is usable for foundry use.

The resins that can be used with this invention are lignin based, liquid protein, starches, acrylics, epoxy ester, polyester polyols, epoxy resins as well as water based versions of these same resins and various combinations can be used. And these resins all contain hydroxyl functionality and/or carbonoxyl functionality that can react with an isocyanate to produce a cured resin. Another advantage of this invention is that water based resins can be used and also cured with the appropriate isocyanate. The exact pressure that is used depends on the fineness of the sand and also the resin level of the sand, also the clamping pressure of the equipment, and also the geometry of the sand core.

What is claimed is:

1. A process for producing a sand core which has been previously coated with resin, said resin being mixture of an isocyanate and a component selected from the group consisting of lignin, liquid protein, starches, epoxy ester, polyester polyols, polyether polyols, and epoxy resins, said process further utilizing heated air as a catalyst, said heated air having a temperature in the range of 180° F. to 1000° F., comprising the steps of:

filling a mold with said sand which has been previously coated with a resin, said resin being a mixture of an isocyanate and a component selected from the group consisting of lignin, liquid protein, starches, epoxy ester, polyester polyols, polyether polyols, and epoxy resins; and, heating said sand core with air having a temperature in the range of 180° F. to 1000° F.

2. A process as claimed in claim 1 wherein heating said core with air continues for one minute at a temperature of 270° F.

3. A process as claimed in claim 1 wherein said resin is a lignin based resin.

4. A process as claimed in claim 2 wherein said coating of said previously coated sand is a liquid coating.

* * * * *